United States Patent [19]

Ericsson

[11] Patent Number: 4,953,459

[45] **Date of Patent: * Sep. 4, 1990**

[54] METHOD FOR POSITIONING MATERIAL IN A PLURALITY OF PRINTING POSITIONS FOR MULTI-COLOR SILKSCREEN PRINTING

[75] Inventor: Sylve J. D. Ericsson, Tumba, Sweden

[73] Assignee: Svecia Silkscreen Maskiner AB, Sweden

[ * ] Notice: The portion of the term of this patent subsequent to Aug. 7, 2007 has been disclaimed.

[21] Appl. No.: 237,703

[22] Filed: Aug. 29, 1988

[30] Foreign Application Priority Data

Sep. 23, 1987 [SE] Sweden ..... 8703669

[51] Int. Cl.[5] ..... B41F 15/10

[52] U.S. Cl. ..... 101/115; 101/129; 101/485

[58] Field of Search ..... 101/DIG. 36, 115, 126, 101/129, 481, 485, 486

[56] References Cited

U.S. PATENT DOCUMENTS

| | | | |
|---|---|---|---|
| 3,329,796 | 7/1967 | Manwaring . | |
| 3,812,779 | 5/1974 | Cobb | 101/115 |
| 3,998,156 | 12/1976 | Zimmer | 101/115 |
| 4,214,522 | 7/1980 | Bille | 101/128.4 |
| 4,221,165 | 9/1980 | Ericsson | 101/126 |
| 4,226,181 | 10/1980 | Ericsson | 101/DIG. 36 |
| 4,485,447 | 11/1984 | Ericsson | 101/129 X |
| 4,516,495 | 5/1985 | Ericsson | 101/DIG. 36 |
| 4,516,695 | 5/1985 | Garneau . | |
| 4,589,335 | 5/1986 | Svantesson | 101/114 |
| 4,610,200 | 9/1986 | Metso | 101/126 |

FOREIGN PATENT DOCUMENTS

| | | |
|---|---|---|
| 1944858 | 3/1971 | Fed. Rep. of Germany . |
| 2045728 | 11/1980 | United Kingdom . |

*Primary Examiner*—Clifford D. Crowder

*Attorney, Agent, or Firm*—Burns, Doane, Swecker & Mathis

[57] ABSTRACT

A method for use in multicolor silkscreen printing in which a plurality of printing stations are provided. A control unit is provided in which the position of the material is calculated in relation to a reference value, for example, the printing machine chassis. The position of the material is then determined along with a material feed position and a resultant measurement value is derived. The material is then moved to a second registration position in order to receive a further pattern thereon. After the second pattern has been applied, the print material is returned to the first registration position in order to reference the position of the pattern printed thereon at the second registration position. After a comparison of the first registration position and the second registration position, any established discrepancy between the actual position of the pattern during the transfer is then minimized with respect to subsequent printing operations.

15 Claims, 1 Drawing Sheet

METHOD FOR POSITIONING MATERIAL IN A PLURALITY OF PRINTING POSITIONS FOR MULTI-COLOR SILKSCREEN PRINTING

TECHNICAL FIELD

The present invention relates to a method in multi-colour silk screen printers which incorporate a multiple of printing stations, for positioning in each of the printing stations in relation to print material a second print pattern which is to be applied to said material and which derives from a first print pattern formed on a stencil such that respective second print patterns will take a predetermined position or location relative to said print material.

In the case of multi-colour silk screen printers, for which the invention is particularly intended, the second pattern is formed by forcing an ink coating or paste through perforations in a cloth forming respective first patterns, onto the print material in a respective printing position, e.g. with the aid of a squeegee.

The invention is based on the assumption that the co-ordinates which define the specific position of the second print pattern in relation to the print material is stored in a memory so as to enable the co-ordinates applicable to any position to be compared readily with the stored co-ordinates applicable to the specific position of the pattern relative to the print material, thereby showing any positional discrepancy in sense of magnitude and direction.

Although reference has been made in the aforegoing to a "multi-colour" printer and "multi-colour" prints on patterns, it will be understood that these terms and those used hereinafter, do not imply that a "colour" print is made on the material from the second pattern in each print station, but will also be understood to include such "colourless" patterns as those obtained when the second pattern is applied to the material in a manner to provide a selected coating of, e.g. soldering paste, solder-stop varnish or the like, in the manufacture of printed circuit boards.

BACKGROUND PRIOR ART

Although various designs of silk screen printers are known to the art, those machines are constructed for the application onto print material of one, and solely one, specific second pattern corresponding to a first pattern formed on the stencil.

The number of multi-colour silk screen printers proposed in the art is very limited, by which is meant a single printer in which a plurality of patterns are mutually applied to one and the same print material in superimposed orientation.

The present invention relates nevertheless to such a silk screen printer which is intended to produce multi-colour prints.

The European Patent Application No. 8711 1078.2 and the U.S. Pat. No. 4,589,335 describe and illustrate a silk screen printer which incorporates a plurality of sequentially positioned printing stations provided with printing tables over which there is located a stencil frame having a stencil stretched therein, and which enable a multi-colour print to be applied to one and the same print material.

In relation to the measures taken in accordance with the present invention, it can also be mentioned that the U.S. Pat. No. 4,516,495 also teaches a method for positioning in one printing position a second pattern, deriving from a first pattern formed on a stencil, in relation to print material intended to receive the second pattern, and in which method said second patterns are formed by creating conditions whereby a coating or ink paste for application to the upper surface of said print material is allowed to pass through the perforations or open mesh in the stencil, or cloth, which forms the first pattern, e.g. with the aid of a squeegee used in a silk screen printer.

It is proposed that when applying this known method the two dimensional position of the second pattern in relation to a reference point, normally a part of the frame of the printer, is stored in a memory, and that when the material on which the second pattern is to be printed is moved into a printing location, the intended position of the material or a pattern which has previously been applied thereon, is evaluated together with any discrepancy which might occur should the second pattern be applied to the material with said material in said intended printed position.

It is also proposed that a stencil carrying the first pattern and/or a printing table and/or the actual material itself, is moved in dependence on the size and direction of any discrepancy established, so that in this printing location the second pattern will be printed on the material with the earlier established discrepancy fully or satisfactorily compensated for.

When practising this earlier known method one or more means which detect and establish the position of the material is/are moved in between stencil and material in a printing location, so as to enable the size and direction of a discrepancy to be evaluated, and the material on the pattern is moved in a manner to compensate for any evaluated discrepancy before printing is commenced.

The teachings of the U.S. Pat. No. 4,221,165 also belong to the state of the prior art in the present respect. This patent describes and illustrates a silk screen printer which has a plurality of gripping beams which in a first position, a feed position, grip the material on which print is to be applied and are then registered in a second position, a print position, in which said print is applied to the material. This enables the material to be moved through a precise transport path of definite length, from the material feed position to the printing position. This precise material transport path is obtained because each of the gripping beams can be registered mechanically in both of said positions, in relation to the printer chassis or a part thereof.

It is also proposed that in addition to a first registering means, which co-acts with a gripping beam for registering the material in the first position, there is also provided separate means which co-act with the material in a manner to register the material precisely in said first position, such that a positionally registered gripping beam collects a pre-registered print material and transports the material to the printing position through a precise material transport path.

SUMMARY OF THE INVENTION

Technical Problems

When considering the known prior art as expressed above, it will be seen that a technical problem resides in the provision of simple means whereby the print material can be positioned, or oriented, outside respective printing positions in a manner such that when said material is displaced to a respective printing location, the material will be positioned normally subsequent to some adjustment, so as to enable a second pattern deriving from the first pattern of a stencil to be applied to the material with a minimised discrepancy.

It will also be seen that a more complicated problem resides in the provision of a multi-colour print with the minimum discrepancy, without placing excessively high requirements on precise registrations relative to the printer chassis in the feed position.

It will also be seen that a technical problem in the case of multi-colour printers resides in the provision of means which will enable each print previously applied to a print material to serve as a standard, by storing, with the aid of a single optical detector in a data system, the relevant two-dimensional positional values applicable to respective prints in relation to the printer chassis or some other reference point, so that the positions of respective stencils can be adjusted with the aid of stepping motors to a position which results in correct orientation of respective second patterns on the material in the printing location and during printing.

When considering the state of the prior art as described above it will be seen that a further technical problem resides in the ability to position the second pattern precisely on one and the same piece of print material in each of the printing positions or locations used, preferably to a degree of accuracy similar to that achieved with a silk screen printer of the kind described in the U.S. Pat. No. 4,516,495, but where reading of higher than that achieved with a printer according to U.S. Pat. No. 4,156,495, without departing from the requirement of satisfactory accuracy with regard to the position of the second pattern on the print material, particularly when manufacturing printed circuit cards.

In the case of this particular application, a further technical problem resides in the provision of conditions, with the aid of simple means, which subsequent to earlier normalization or calibration will enable the relevant position in each printing station of material which is to receive a multiplicity of prints in the form of a number of mutually different patterns to be already established in a material feed position and enable the position of a first pattern formed on a stencil in relation to the material to be changed when necessary, and in response to the position detected in said feed positions, so that when the material is displaced to respective printing positions through a precise transport path, a second pattern applied to the material in respective printing positions will have a pre-determined orientation in relation to the material.

It is advantageous in this case to incorporate measures which will enable the material to be moved along an exact length of a transport path, to within narrow tolerances, from a material feed position to each of a number of printing positions or locations without changing the orientation of the material.

A further technical problem resides in the provision of means which will ensure that the second pattern is printed in the correct place on the material, even though the material should deviate from the precise or exact transport path.

It will also be seen that another technical problem with regard to determining the position of the material in a material feed location resides in the ability to compensate for the discrepancy which can be expected to occur in each printing location or position as a result of stretching of the first stencil pattern when this first pattern is transferred with the aid of a squeegee to the material to form a second pattern.

A further technical problem resides in the provision of conditions, with the aid of simple means, which will enable normalization or calibration of the positions of the various second patterns to be effected by displacing print material in a precise manner from a first material feed location to a respective printing position and, subsequent to printing a second pattern on said material by moving the printed material back to the material feed location, so as to be able to establish the position of the applied print on the material in said feed location and to store the two-dimensional co-ordinates thus obtained and therewith establish the manner in which the position of the stencil needs to be adjusted in the prevailing printing location in order for the second pattern to be printed in the correct position on the print material. A subsequent technical problem resides in the provision of conditions, with the aid of simple means, whereby with the aid of this information printing of the second pattern on each subsequent piece of print material in each printing station can be controlled and regulated so that the second pattern will be printed in a pre-determined position with a positional deviation smaller than 0.5mm, preferably smaller than 0.03mm, such accuracy being necessary in the manufacture of printed circuit board.

Another technical problem in this regard is one of realizing that the accuracy afforded is related strongly to the resolution of the detecting means or camera equipment used, and also to the possibility of measuring the transport path and position of the conveyor belt with great accuracy.

In the case of printers in which there is used only a single conveyor belt which passes all printing stations, a further technical problem resides in the provision of conditions which will enable the position of the material to be established indirectly at each printing station, by establishing directly the momentary position of the conveyor belt and therewith create conditions for moving the stencil and therewith adjusting the position of the second pattern relative to the material, so as to compensate for any deviation of the belt from its position applicable during the normalizing or calibrating procedure.

SOLUTION

The present invention relates to a method in multicolour printers comprising a multiple of printing stations, for orientating in each of said stations a second print pattern deriving from a stencil-carried first pattern in relation to print material intended to receive said second pattern, such that each respective second patterns will have a pre-determined position in relation to said material, and in which method the second pattern is formed or applied by causing a coating substance to pass through the first pattern in each printing station and onto the print material, e.g. with the aid of a squeegee.

For the purpose of calibrating the positions of respective second patterns in relation to the print material it is proposed in accordance with the invention.

(a) That in a first registered location, a print material feed location, the position of the material is read-off against a reference value, e.g. a reference point on the printer chassis or a part thereof, and that the resultant information is stored.

(b) That the material is transferred to a second registered position, a printing location in a first printing station, for receipt of a second pattern belonging to the first printing station.

(c) That the material printed with the second pattern in accordance with (b) above is moved again to the first position and the position of the printed second pattern in relation to said reference is read-off in this registered position and stored.

(d) That in response to an established discrepancy between the actual position of the pattern, obtained in the transfer according to "b" above and its pre-determined position, the stencil frame carrying the first pattern is displaced in the first printing station to an extent and in a direction such as to minimise the discrepancy established, and (e) That each subsequent print material, registered in a similar manner in the first, second and following positions, are coated in the second and following positions in the first and following printing stations, with respective second pattern being applied with a minimised discrepancy.

In accordance with a further development of the invention, the expression "minimised discrepancy" is meant to imply full compensation for an established discrepancy, or at least compensation which can be accepted as satisfactory under the circumstances.

The print material will preferably rest on a single conveyor belt which passes through the entire printing machine, and is registered in the first position by establishing the position of the belt. The distance of the path travelled by the conveyor belt up to the second registered position is measured and the measurement value stored, wherein the second pattern is applied to the print material in the first printing station in accordance with "b" above. The print material is returned to the first registered position, by feeding backwards along the same transport path and there evaluating the position of the second pattern on the material. The magnitude and directional sense of any discrepancy is established and the position of the stencil frame is adjusted so as to minimise the discrepancy in the position of a subsequent print.

The print material is then moved to a third registered position, a printing position in a second printing station, and there receives the second pattern belonging to the second printing station.

The distance travelled by the conveyor belt to the third registered position is measured and the resultant measurement value stored. In this case, the distance shall be twice the previously mentioned distance. The material is provided here with its second pattern in the second printing station according to "b" above, whereafter the material is returned to the first registered position by feeding the material backwards along the transport path and the position of the second pattern on the material is evaluated. The magnitude and directional sense of any discrepancy is established and the position of the stencil frame is adjusted so that a subsequent print is positioned on the print material with the minimum discrepancy.

The belt is then moved along a transport path up to a fourth registered position, in which the material is provided with the second pattern in the third printing station according to "b" above, whereafter the material is returned to the first registered position, by feeding the material backwards along said transport path, whereafter this procedure is repeated as often as necessary. The distance of this transport path to the fourth registered position is three times the length of the first mentioned distance.

The discrepancy measured in the first registered position between the actual position of the second pattern on the material and its pre-determined position is evaluated in order to enable the second pattern applied in respective printing stations to be displaced to an extent which will compensate for the discrepancy established.

In order to enable checks to be carried out it lies within the scope of the invention to establish at each printing station the discrepancy between the position of the belt and of the material when making a calibration and the position of the belt and of the material during a prevailing printing sequence, so that the position of the stencil frame can be adjusted to compensate for this discrepancy.

The invention also relates to a silk screen printer which incorporates a multiple of printing stations and a conveyor belt which conveys a plurality of material pieces to receive print from a material feed position to a first printing station, and from there to a second printing station, and so on, to an outfeed position, each printing station comprising a stencil which carries a first print pattern which is transferred to the print material as a second print pattern with the aid of a squeegee.

The stencil and stencil frame of each printing station are displaceably arranged so as to enable the second pattern to be applied to the print material with minimised discrepancy when printing material is transported by the conveyor belt and halted in a given position relative to the printing station.

Displacement of respective stencil frames in respective printing stations towards a minimised discrepancy is controlled by a control unit which is common to all printing stations.

When the conveyor belt is stopped, print material will be located in each printing station. It may be suitable in this regard to determine the position of the conveyor belt and therewith the relevant position on the material, in each printing station, so that the position of the stencil frame for each printing station can be adjusted prior to printing, so as to compensate for any discrepancy which occurs between the actual position of the material and its pre-determined position.

ADVANTAGES

Those advantages primarily afforded by the present invention reside in the provision of conditions which enable the position of print material to be registered in a material feed location in a multi-colour silk-screen printer and to enable respective second patterns to be applied precisely to the print material when the said material is moved through a transport path to respective printing positions, without requiring herefor subsequent checks of the print position, by introducing position detecting means between stencil and material.

BRIEF DESCRIPTION OF THE DRAWINGS

An embodiment of a silk-screen printer at present preferred and constructed for carrying out the method according to this invention will now be described in more detail with reference to the accompanying drawings, in which;

FIG. 2b illustrates a graduated marking scale provided on the undersurface of the conveyor belt of FIG. 2a.

DESCRIPTION OF EMBODIMENTS AT PRESENT PREFERRED

Figure 1:
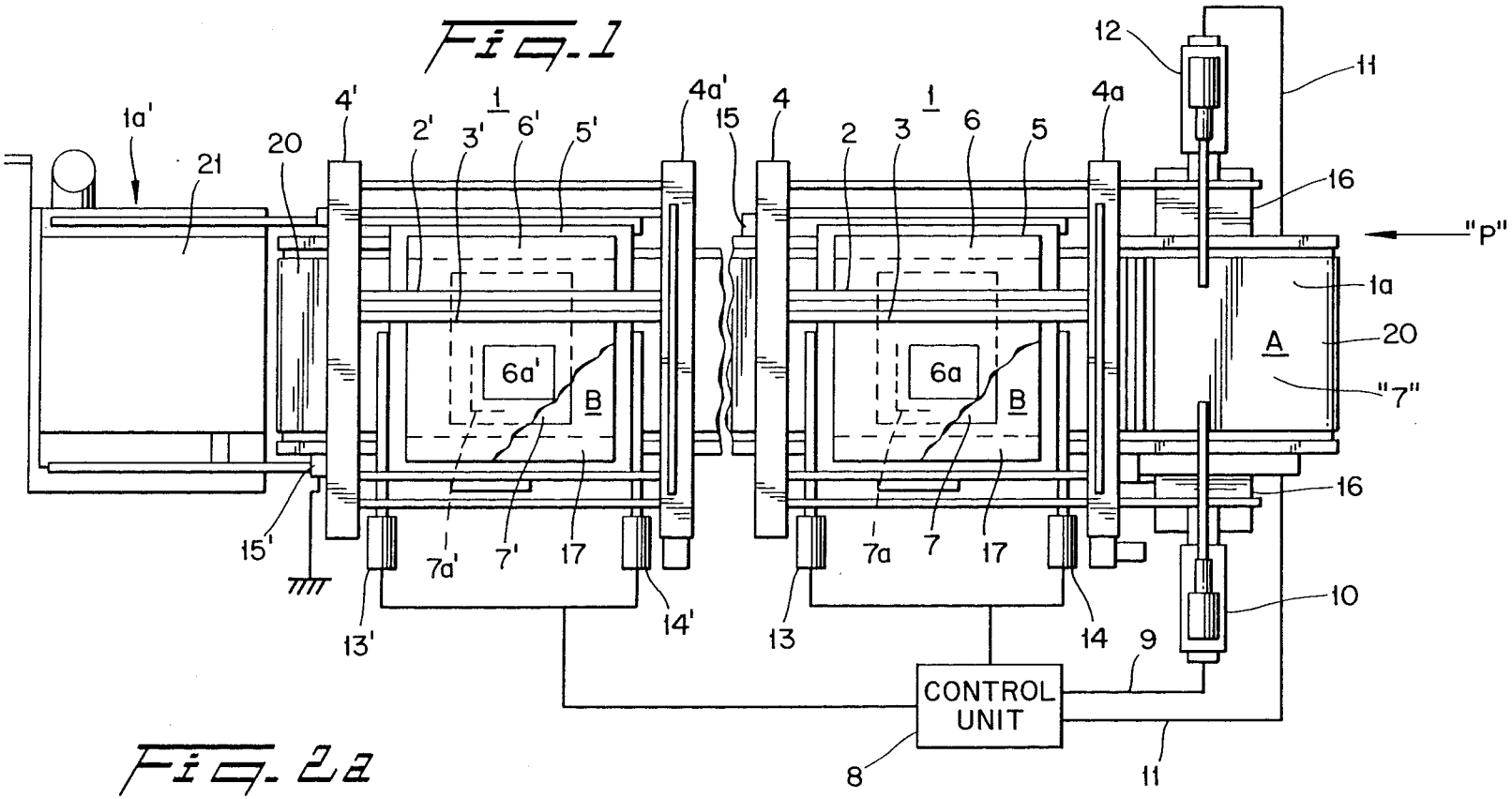
FIG. 1 is a horizontal view, highly simplified, of part of a silk-screen printer.

FIG. 1 is a horizontal view of a multi-colour silk-screen printer.

The reference 1 identifies a first printing station having an associated print material feeder 1a.

The printer incorporates a number of printing stations corresponding to the number of different colours to be printed, as seen in the direction of transport "P". There are normally three or four such stations, although the stations may be more or less in number.

The printing stations are mutually identical, although with the difference that the first printing station 1 has a stencil which carries a first pattern which normally differs from the first pattern carried by the stencil associated with the next following printing station, and so on.

The illustration of FIG. 1 has been simplified, by showing solely the first printing station 1 with associated feeder 1a, and the last printing station 1' with associated feeder 1a'

It will be understood that the number of printing stations located between those illustrated may vary, and that these printing stations are, in principle, of the same construction as those illustrated.

For the sake of simplification like elements in the last printing station 1' are identified by the same reference signs as those used in the first printing station, although complimented with a prime (1 and 1', 2 and 2' etc).

It will be seen from FIG. 1 that the first printing station 1 includes a squeegee arrangement 2 with filler 3, which can be moved reciprocatingly transversely of the material transport direction "P" in guides 4, 4a. Moveably mounted in a stencil frame 5, but nevertheless fixed in relation to the printer chassis, is a stencil 6, which carries a first pattern 6a. This pattern 6a is transferred to or printed on print material 7 in the form of a second pattern 7a, by means of the squeegee arrangement 2.

Thus there are two slightly different patterns, namely the first pattern 6a and the second 7a. These two patterns differ from one another not only because one pattern is formed on the stencil and the other is applied as a print on the print material, but also because of a slight distortion of the first pattern caused by stretching of the stencil cloth as the squeegee moves when applying the first pattern to the print material to form the second pattern.

The position of the second pattern 7a on material 7 has been exaggerated in the figure on one side of the first pattern 6a, for reasons of clarity.

The invention primarily relates to a method in multicolour silk-screen printers having a plurality of printing stations in which a print is made in each of said stations, for orientating or positioning a second pattern 7a deriving from a first pattern 6a carried on a stencil 6 in relation to print material 7 intended to receive the second pattern 7a, so that the second pattern 7a will have a pre-determined position relative to said print material 7, without needing to introduce material-position determining means between stencil and printing table in respective printing positions.

The second pattern 7a is formed by causing coating substance, printing paste or the like to pass through perforations or meshes located in a cloth and forming the first pattern 6a into abutment with the print material 7, e.g. by means of a squeegee 2, in a position in the first printing station in which the print material 7 is located. The position of the second pattern 7a determined in relation to said printer material 7 must lie stored in a memory in a central control unit 8, suitably constructed for operating the silk-screen printer, for positioning of the second pattern. The control unit 8 is connected to a first camera arrangement 10, via a cable 9, and also to a second camera arrangement 12, via a conductor 11.

Since the present invention does not include the construction of the central unit 8 and since the principle construction of said unit is known to the art in conjunction with silk-screen printers, the following description will not include those functions of the central unit 8 necessary for evaluating the position of the pattern on the print material in the various printing stations and for controlling known stepping motors 13, 14 and 15 for each stencil frame in each printing station. A more comprehensive understanding of the manner in which said pattern positions are determined, the discrepancies calculated and the stepping motors activated can be obtained from the U.S. Pat. No. 610,200.

In order to obtain a better understanding of the present invention it should be noted that the phrase "registered position" as used in the following description and the following claims does not necessarily mean a position which is precisely related to the printer chassis, since this position can vary.

It is essential, however, to establish the two-dimensional co-ordinates of the position of the print material or a print previously applied thereto and to store these co-ordinates, so as to enable an exact position to be evaluated.

Furthermore, when the print material returns to a previously registered position during the calibrating cycle, these two-dimensional co-ordinates shall also be established and the magnitude and directional sense of any discrepancy evaluated.

With reference to the exemplifying embodiment of FIG. 1, for the purpose of calibrating the equipment in a first registered, material-feed position "A", the position of the material 7' is read-off by means of the camera arrangements 10, 12 in relation to a reference point, e.g. the printer chassis 16, and the co-ordinates thus established are stored in the memory of the central unit 8.

A conveyor belt 20 upon which the material 7 rests is now started so as to move the printer material A to a second registered position B, namely a printing position in the first printing station, where the second pattern 7a is applied to the print material as a result of movement of the squeegee 2. The distance travelled by the material shall be determined precisely, as described in more detail hereinafter.

In accordance with the present invention, the print material 7 on which the second pattern 7a was printed in the first printing station 1 is now moved back through an exact transport distance to the first registered feed position A, where the registered position of the printed second pattern 7a is read off relative to said reference point. These co-ordinates are also read-off and stored in a known manner in the central unit 8. One requirement in this regard is that the printed second pattern is oriented on the material within wide tolerance limits, although naturally within those limits placed on the camera arrangement for establishing the position of the pattern.

This is effected by reversing the conveyor belt 20 back to the material feed position A through an exact distance of equal length, and there evaluating the position of the second print 8*a*.

It is possible with the aid of this information to again establish in the material feed position A the position of said material and the position of the print applied thereto, and to compare this position with the correct position of the print in the first printing station and to activate, through the central unit, stepping motors 13, 14 and 15 in a manner which, when the material in the feed position has been transported through a precise transport distance to the first printing station, will enable the second pattern 7A to be transferred with the minimum of discrepancy.

The afore described calibration concerning the position of the second pattern 7*a* on the material 7 can now be repeated in each of the remaining printing stations.

Figure 2B:
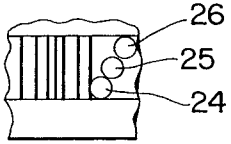
Figure 2A:
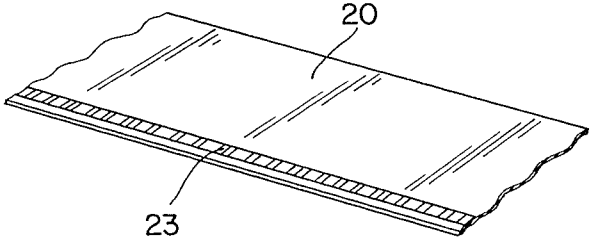
FIG. 2*a* illustrates suitable graduation of a conveyor belt for establishing the position of the conveyor belt and also of the print material.

In order to facilitate detection of the position of the conveyor belt and enable the distance travelled by the belt to be measured, it is proposed that a scale or graduated marking at 23 is provided on the under surface of the conveyor belt, as illustrated in FIG. 2. The marking 23 may comprise optically detectable, individual dashes or a magnetized tape with a read head positioned adjacent the under surface of the conveyor belt, e.g. at the material feed position A.

Since the distance, and therewith the exact transport path between the material feed position A and the first printing station is equal to the distance between the first and the second printing stations, the second and the third printing stations etc., only one single read head is required for evaluating the exact distances travelled by the conveyor belt.

If there is a risk that the measurements of the conveyor belt may change, a read head may be provided at each printing station, in the close proximity of the registered position, so that the momentary position of the conveyor belt in each printing station can be evaluated and, should this position deviate somewhat from the position established during the calibrating procedure, the position of the stencil frame can be adjusted in order to compensate for such discrepancies.

An example of an arrangement which can be used to measure conveyor belt movement, the distance travelled by the conveyor belt, and its position, is described and illustrated in the European Patent Application having publication number 0 083 082.

For example, if the co-ordinates relating to a desired position of a second pattern 7*a* which is the first to be printed of a number of second patterns have already been established in a known manner, it is possible to establish any relevant discrepancy with the aid of the camera arrangements 10 and 12 and the microprocessors of the central unit 8, and to control the stepping motors 13, 14 and 15 of the first printing station 1 in a manner to obtain precise orientation of all subsequent prints. In the case of the illustrated embodiment, these stepping motors 13, 14 and 15 manipulate a stencil frame carrying the stencil 6 in a manner to adjust the position of the stencil 6, and therewith the pattern 6*a* carried thereby, so that said pattern is oriented for precise printing on the material 7.

An arrangement of read heads at each printing station, for establishing the position of the conveyor belt also enables any possible discrepancy in the length of the conveyor path to be introduced as a correction factor for each printing station, for establishing the extent to which respective stencil frames must be moved in order to minimise the discrepancy.

Discrepancies in the transverse direction of the belt can also be evaluated and introduced as a correction factor.

In this case it is assumed that the print material will not slide in relation to the upper surface of the belt during the discontinuous movement of the belt through the machine. This fixed relationship of the print material can be achieved with the aid so-called travelling vacuum.

When a discrepancy is established in the printing station 1' and remaining printing stations between the actual positions of the pattern, obtained when transferring the second pattern, and the pre-determined position of the pattern, the stencil frame 5' with stencil 6' exhibiting the first pattern 6A', is displaced with the aid of the stepping motors 13', 14' and 15', to an extent and in a direction such as to minimise the established discrepancy. The established discrepancy and the extent to which the different stepping motors 13', 14' and 15' are activated are evaluated in the central unit 8 in a known manner.

The actual printing process can commence subsequent to calibrating the positioning of all other patterns on the printer material, and subsequent to completing adjustment of respective stencils to an established correct position in order to minimise discrepancies.

Each subsequent piece of print material will now be registered in the first position A (established position of the material) in the afore described manner and during transportation to the said position B information concerning any possible discrepancy between the position for said material and the position for the material during the calibration process is transferred so that the stencil 6 in the first printing station can be moved so as to compensate for any resultant discrepancy, such that the second pattern 7*a* is applied to the material in the second position B with a minimised discrepancy, to the information stored in the central unit 8 and commensurate activation of the stepping motors.

By "minimised discrepancy" implies, in accordance with the invention, full compensation of an established discrepancy, or a compensated discrepancy which can be accepted as being satisfactory under the circumstances.

When the print material is now moved to the second printing station, the stencil located in said station is also displaced in order to minimise the discrepancy deriving from any possible discrepancy in the material feed position.

Consequently, it is necessary for the central unit 8 to have knowledge of the intended position of each print material in the material feed position and to activate the stepping motors in each printing station when the print material arrives at said station, so that the second print will always be applied with the minimum or minimised discrepancy.

FIG. 1 illustrates 3 pieces of print material 7'',7 and 7' resting on and transported by a conveyor belt which extends through the whole of the printing machine. The print material 7'' is shown located in a registered position in the material feed position A. The print material 7 is shown located in a registered position in the first printing station 1, while the print material 7' is shown located in a registered position in the last printing station 1'.

The phrase "registered position" as used here is not meant to imply that the print material is forced into a given position relative to the chassis, with the aid of mechanical registering devices, but rather that the material is positioned in a defined place so that the stencil frame and the stencil can be moved in a manner to transfer a pattern onto the material in a pre-determined manner.

The conveyor belt 20 now carries the material 7'' to the printing station 1 while, at the same time, moving the print material 7 in the printing station 1 to the next printing station, and so on, so that the material 7', onto which a multiple of colour prints have been applied is transferred to a support surface 21 in the outfeeder 1*a'*.

The transport distance or path between the various printing stations may be of equal or substantially equal lengths.

Respective print materials are printed simultaneously in respective printing stations.

The illustrated silk-screen printer has a multiple of printing stations (1 . . . 1') and respective pieces of print material are transported on a single conveyor belt 20 from a material feed position A to a first printing station 1, to a second printing station etc., and finally to an outfeed position 1*a'*, each printing station including a stencil having a first pattern which is transferred to the print material in the form of a printed second pattern, by means of a squeegee arrangement.

In each printing station the frame carrying the stencil and also the stencil, can be moved by respective stepping motors so that the second pattern can be applied with the minimum of discrepancy to print material transported by the conveyor and stopped in a specific position in the printing station.

This displacement of respective stencil frames in respective printing stations to minimise print discrepancies is controlled in respective printing stations by a control unit which is common to all printing stations, while observing the position of the material, the feed position, the intended material distance, the stencil position and other parameters. When the conveyor belt 20 is stopped print material is located in each printing station.

The position of the conveyor belt can be read off in each printing station, and therewith also the position of the material, and the position of the stencil frame in each printing station is adjusted prior to a printing, in order to compensate for occurrent discrepancies between the actual position of the print material and its pre-determined position.

All data necessary for effecting the aforesaid compensations are stored in and processed by the control unit 8.

An advantage is afforded when a drying section is included between respective printing stations, so that wet print can be dried prior to applying further print.

With regard to establishing the position of the conveyor belt (and therewith also the position of the print material), with regard to longitudinal directions, the separate markings may be unambigiously and individually defined to enable the transport distance in question to be established.

With regard to the establishment of the belt position in a cross direction, it may be suitable to establish the position of the markings with the aid of one or more read heads.

For example, the read head 24 (see FIG. 2*b*) may be arranged to detect one edge part of the belt, the head 25 may detect the centre part of the belt, and the head 26 may detect the other edge part of said belt, thereby establishing the prevailing position of the belt in a transverse direction.

It will be understood that the aforedescribed exemplifying embodiment does not limit the invention and modifications can be within the scope of the following claims.

I claim:

1. A method in multi-color silkscreen printers which incorporate a multiple of printing stations, for positioning in each of the printing stations in relation to print material a second print pattern which is to be applied to said print material and which derives from a first print pattern carried by a stencil, such that respective second print patterns will take a pre-determined position or location relative to said print material, in which method the second pattern is applied by causing coating substance to pass through the first pattern in one printing position and onto the print material comprising the steps of;

(a) determining the position of the print material in relation to a reference value in a first print-material registered position, a material feed position, and storing the resultant measurement value;

(b) transferring the print material to a second registered position, a printing position in a printing station for receipt of a second pattern belonging to the first printing station;

(c) moving the material printed with the second pattern back to the first position and determining the position of the printed second pattern in relation to said reference value in the first position, and storing the measurement value;

(d) displacing the stencil frame carrying the first pattern in the first printing station to an extent and in a direction such as to minimize a discrepancy established between the actual position of the pattern, obtained in the transfer and the pre-determined position of said pattern; and (e) applying a second pattern with minimized discrepancy in the second position in the first printing station to each subsequent material registered in a similar manner in the first and the second position.

2. A method according to claim 1, wherein the minimized discrepancy is full compensation of an established discrepancy.

3. A method according to claim 2, wherein the print material rests on a belt which extends throughout the whole printing machine and is registered in the first position; the distance of the transport path up to the second registered position is measured; the material is provided with the second pattern in the first printing station; and the print material is returned to the first registered position by reversing said material through the same transport path.

4. A method according to claim 3, characterised in that the print material is passed to a third registered position, a printing position in the second printing station for receipt of the second pattern associated with the second printing station.

5. A method according to claim 4, characterised by measuring the transport distance of the belt up to the third registered position; applying the second pattern to the print material in the second printing station; and by returning the print material to the first registered position by reversing said material along the same transport path.

6. A method according to claim 2, characterised by evaluating the discrepancy measured in the first registered position between the actual location of respective second patterns of the print material and their pre-determined locations or positions; and displacing the second pattern applied in respective printing stations so as to compensate for said discrepancy when applying the second pattern to said print material in respective stations.

7. A method according to claim 1, wherein the print material rests on a belt which extends throughout the whole printing machine and is registered in the first position; the distance of the transport path up to the second registered position is measured; the material is provided with the second pattern in the first printing station; and the print material is returned to the first registered position by reversing said material through the same transport path.

8. A method according to claim 7, characterised by measuring the transport distance of the belt up to a third registered position; applying the second pattern to the print material in the second printing station; and returning the print material to the first registered position by reversing said material along a transport path.

9. A method according to claim 8, characterised by measuring the transport distance of the belt up to a fourth registered position, applying the second pattern to the print material in a third printing station; and returning the print to the first registered position by reversing the material along said transport path.

10. A method according to claim 7, characterised in that the print material is passed to a third registered position, a printing position in the second printing station, for receipt of the second pattern associated with the second printing station.

11. A method according to claim 10, characterised by measuring the transport distance of the belt up to the third registered position; applying the second pattern to the print material in the second printing station; and by returning the print material to the first registered position by reversing said material along said transport path.

12. A method according to claim 7, characterised by evaluating the discrepancy measured in the first registered position between the actual location of respective second patterns of the print material and their pre-determined locations or positions; and displacing the second pattern applied in respective printing stations so as to compensate for said discrepancy when applying the second pattern to said print material in respective stations.

13. A method according to claim 1, characterised in that the print material is passed to a third registered position, a printing position in the second printing station, for receipt of the second pattern associated with the second printing station.

14. A method according to claim 13, characterised by measuring the transport distance up to the third registered position; applying the second pattern to the print material in the second printing station; and by returning the print material to the first registered position by reversing said material.

15. A method according to claim 1, characterised by evaluating the discrepancy measured in the first registered position between the actual location of respective second patterns of the print material and their pre-determined locations or positions; and displacing the second pattern applied in respective printing stations so as to compensate for said discrepancy when applying the second pattern to said print material in respective stations.

* * * * *